United States Patent [19]

Gramera

[11] Patent Number: 4,720,108

[45] Date of Patent: Jan. 19, 1988

[54] VISUAL SYSTEM DIFFERENTIATING IDENTICAL SUMS OF TWO NUMBERED DICE

[76] Inventor: Robert E. Gramera, 1027 Raleigh St., Denver, Colo. 80204

[21] Appl. No.: 804,919

[22] Filed: Dec. 5, 1985

Related U.S. Application Data

[63] Continuation-in-part of Ser. No. 650,666, Sep. 14, 1984, abandoned.

[51] Int. Cl.[4] ..... A63F 9/04

[52] U.S. Cl. ..... 273/146; 273/269; 273/271

[58] Field of Search ..... 273/146

[56] References Cited

U.S. PATENT DOCUMENTS

| | | | |
|---|---|---|---|
| 1,257,779 | 2/1918 | Anderson | 273/146 |
| 3,977,677 | 8/1976 | Magiera | 273/146 |
| 3,977,679 | 8/1976 | Magiera | 273/146 |
| 4,046,381 | 9/1977 | Comeaux | 273/146 |
| 4,158,921 | 6/1979 | Stolpen | 273/146 |
| 4,585,232 | 4/1986 | Sheppard et al. | 273/146 |

FOREIGN PATENT DOCUMENTS

| | | | |
|---|---|---|---|
| 213695 | 2/1955 | Australia | 273/146 |
| 560302 | 3/1944 | United Kingdom | 273/146 |

*Primary Examiner*—Richard C. Pinkham
*Assistant Examiner*—Gary Jackson

[57] ABSTRACT

A visual system illustrates how many identical numerical sums turn up when two numbered dice are rolled out and how the identical numerical sums are visually differentiated, one from the other, by coding each of six numbered faces of a first die and by not coding any of the six numbered faces of a companion neutral second die. Thirty-six possible numerical sums are established when each of the six numbered and coded faces of the first die is oriented on a horizontal axis of a grid and when each of the six numbered faces of the companion neutral second die is oriented on the vertical axis of the grid. Within the thirty-six numerical sums, exists nine separate collective groups of sums, ranging in group values from three to eleven, wherein the identical sums within each collective group are visually differentiated, one from the other. The system affords a practical basis to create a variety of new dice related games, incorporating game boards, playing cards or a combination thereof.

2 Claims, 4 Drawing Figures

PENTANGLES

VISUAL SYSTEM DIFFERENTIATING IDENTICAL SUMS OF TWO NUMBERED DICE

This is a continuation-in-part of application Ser. No. 650,666 filed Sept. 14, 1984 and now abandoned.

FIELD OF INVENTION

This invention describes a visual system that clearly shows how many identical numerical sums turn up when two numbered dice are rolled out and combined with the application of coding one die in a dice pair, further shows how the identical sums, within a collective group sum, are visually differentiated, one from the other.

BACKGROUND OF THE INVENTION

With a pair of standard dice of one shade, the face of each six-sided die contains one of six numbers ranging in value from 1 through 6, usually represented by furrowed dots commonly referred to as pips. The number of pips on one side of a die, added to the number of pips on the opposite side, will always display the sum of seven. In any kind of dice game, both dice are shaken together and rolled out on either a table or a playing board. The number of pips that appear on the upper face of each die, added together, gives one of eleven numerical sums, the value of which determines the outcome of a dice game.

Since there are six ways each of two six-sided dice can turn up in a dice roll, 6 (die one)×6 (die two), thirty-six possible numerical combinations of two dice will give the eleven numerical sums ranging from two through twelve as shown in Table 1.

TABLE 1

| ELEVEN SUMS OF TWO DICE | COMBINATIONS OF TWO NUMBERED DICE: THIRTY-SIX POSSIBLE NUMERICAL SUMS | |
|---|---|---|
| 2 | | 1 + 1 (Snake Eyes) |
| 3 | Nine Group Sums | 1 + 2, 2 + 1 |
| 4 | | 1 + 3, 3 + 1, 2 + 2 |
| 5 | | 1 + 4, 4 + 1, 2 + 3, 3 + 2 |
| 6 | | 1 + 5, 5 + 1, 2 + 4, 4 + 2, 3 + 3 |
| 7 | | 1 + 6, 6 + 1, 2 + 5, 5 + 2, 3 + 4, 4 + 3 |
| 8 | | 2 + 6, 6 + 2, 3 + 5, 5 + 3, 4 + 4 |
| 9 | | 3 + 6, 6 + 3, 4 + 5, 5 + 4 |
| 10 | | 4 + 6, 6 + 4, 5 + 5 |
| 11 | | 5 + 6, 6 + 5 |
| 12 | | 6 + 6 (Box Cars) |

Examination of Table 1, clearly shows how many identical sums are possible within nine separate collective groups of sums, ranging in value from three to eleven. With a pair of standard dice of one shade, the identical sums within any one of the nine groups of sums are observed one way, collectively, when the dice are rolled. Even though, there are thirty-six numerical combinations that can be rolled, only eleven sums, ranging in value from two to twelve are observed. For example, the six ways number seven can turn up in a dice roll are: 1 (die one)+6 (die two); 6 (die one)+1 (die two); 2 (die one)+5 (die two); 5 (die one)+2 (die two); 3 (die one)+4 (die two) and 4 (die one)+3 (die two). However, with a pair of standard one color dice, it is impossible to visually discern the three pairs of numbers on one die from the three pairs of numbers on the companion die in any of the six rolled combinations of dice to obtain the sum of seven. Even though there are six separate ways number seven can turn up in a dice roll, there are no games that can be played with a pair of standard one color numbered dice, to visually differentiate the six possible ways to obtain seven, or for that matter, any of the combinations for the numerical sums of three, four, five, six, eight, nine, ten or eleven.

Since the two dice in a pair of standard dice are of the same color, it is impossible for game participants to visually differentiate each of the thirty-six rolled sums of the two dice that collectively display the eleven numerical sums, ranging in value from two through twelve. Without the ability to visually differentiate these thirty-six possible numerical sums of the two dice, all current dice related games using a pair of one color dice, incorporating various playing boards, playing cards or a combination thereof, are limited to only eleven visually discernable numerical sums, each of which turns up in varying odds.

The probability, percent (P) and odds for the eleven numerical sums, ranging in value from two to twelve, observed with a pair of standard one color dice, are summarized in Table 2.

TABLE 2

| ROLLED SUM | NUMBER OF WAYS (COMBINATIONS) | PROBABILITY (P) | % (P) | ODDS |
|---|---|---|---|---|
| 2 | 1 | 1/36 | 3 | 35 to 1 |
| 3 | 2 | 1/18 | 6 | 17 to 1 |
| 4 | 3 | 1/12 | 8 | 11 to 1 |
| 5 | 4 | 1/9 | 11 | 8 to 1 |
| 6 | 5 | 1/7 | 14 | 6 to 1 |
| 7 | 6 | 1/6 | 17 | 5 to 1 |
| 8 | 5 | 1/7 | 14 | 6 to 1 |
| 9 | 4 | 1/9 | 11 | 8 to 1 |
| 10 | 3 | 1/12 | 8 | 11 to 1 |
| 11 | 2 | 1/18 | 6 | 17 to 1 |
| 12 | 1 | 1/36 | 3 | 35 to 1 |

Color or symbol coding each of six or more numbered or unnumbered faces on one die or multiples of such dice, as a means to develop specific dice related games, incorporating playing boards, playing cards or a combination thereof, is widely exemplified in the patent literature, with specific references cited in U.S. Pat. Nos. 1,481,628; 1,631,505; 2,526,300; 2,992,652; 3,055,662; 3,433,483; 3,709,498; 3,977,679; 4,015,850; 4,046,381; 4,261,574; 4,335,879; 4,346,900 and 4,436,306. However, no where in the patents cited or for that matter in the general patent literature, has it been found or is it apparent to one skilled in the art, that a visual system was ever developed to show how the identical sums of two numbered dies are visually differentiated one from the other.

SUMMARY OF THE INVENTION

Differentiating each of the six numbered faces on one die in a pair of numbered dice, with either color or symbol coding and by retaining all six numbered faces on the companion neutral die in a shade of, for example, either black or white, provides a means whereby the identical numerical sums contained within eleven observed sums, ranging in value from two through twelve, can be visually differentiated, one from the other. Development of a visual system that establishes the number of collective identical sums with a pair of numbered dice, combined with the application of coding one die in the dice pair, provides a basis to create a wide variety of new and exciting dice games that may incorporate game boards, playing cards or a combination thereof, with three different game boards, that exemplify the novelty of the invention.

BRIEF DESCRIPTION OF THE DRAWINGS

The invention will be more readily understood by referring to the accompanying drawn figures, which are intended as illustrative of the invention, rather than as limiting the invention to the specific details herein set forth.

DETAILED DESCRIPTION OF THE INVENTION

Figure 1:
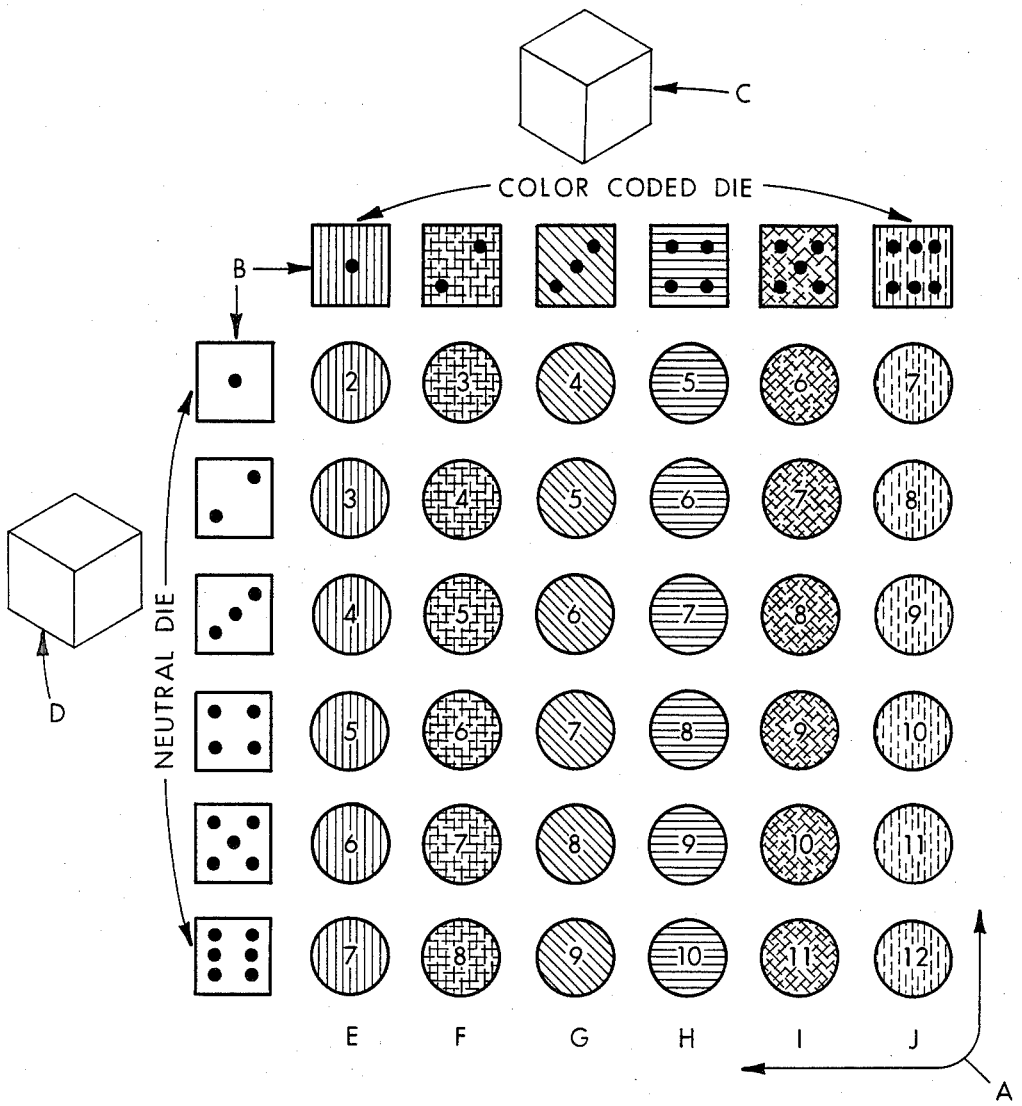
FIG. 1 depicts the visual grid system that shows how many identical numerical sums are contained within nine separate groups of collective sums, ranging in value from three to eleven and how the identical sums within each of the nine groups are differentiated with the application of coding.

To render the instant invention readily understandable, FIG. 1 illustrates a visual grid system, wherein each of the six numbered faces of a coded first die C is oriented on a horizontal axis of a grid, resulting in thirty-six possible numerical sums A, when each of the six numbered faces of a companion neutral second die D, is oriented on a vertical axis of the grid. Prior to coding die C, it becomes readily apparent that there exists nine separate groups of collective sums, each containing identical sums ranging in value from three to eleven. For example, the sum of three, observed in vertical column E, is also observed in vertical column F, thus constituting one of nine collective groups of sums. Five identical sums of eight are found in columns, F, G, H, I and J, again constituting another one of nine collective groups of sums. In all, there are nine collective groups of sums containing numerical values from three to eleven. Without the application of coding one die in a dice pair, the identical numerical sums within each of the nine groups of sums, cannot be visually differentiated, even though all of the identical sums are established in the grid containing the thirty-six numerical sums of FIG. 1.

The thirty-six possible numerical sums A of two six-sided numbered dice B is visually differentiated with different colors on each of six numbered faces on the coded first die C and by retaining all six numbered faces in either, for example, a black or white shade on a companion second die, hereinafter referred to as the "neutral" die D. Whereas each of the eleven visually differentiated sums, ranging in value from two through twelve, is rolled at varying odds with a pair of standard one color dice, each of the thirty-six visually differentiated numerical sums A is rolled with equal odds of 1 in 36 with a pair of dice B. For example, since one face of the coded die C is colored in red, all numerical sums with values ranging from two through seven, running vertically on the grid in FIG. 1 in the color coded series E, will turn up as a red numerical sum in a dice roll, when the color coded first die C is rolled out together with the companion neutral second die D. This rationale further applies to dice rolls, for example, in the yellow F, green G, blue H, orange I and purple J series.

Since there are six ways each of the two six-sided dice B can appear in a series of dice rolls, there are thirty-six possible numerical sums A whereby each of eleven numerical sums, from two through twelve, can collectively turn up when the pair of dice B is rolled out over an extended period of time. Except for the numerical sums of two and twelve, it is impossible to visually differentiate the identical numerical sums of three through eleven, when a pair of standard one color dice is rolled. This is readily apparent when you examine FIG. 1, and substitute the color coded die C with a neutral die D. When two neutral dice D are rolled, visual differentiation of any combination of the two dice for obtaining the numbers ranging from three through eleven, in thirty-four possible combinations, is virtually impossible. However, when the coded first die C and neutral second die D are rolled out, the coded sum is established by adding together the numerical values that appear on the upper face of both dice B, with each of the thirty-six possible numerical sums A, differentiated, one from the other, by the color that appears on the upper face of the color coded die C.

For example, whereas the collective numerical sums of seven can be rolled out in six possible ways, visual differentiation of each identical sum of seven is not possible with a standard pair of one color dice. However, whereas the color coded die C in any dice roll visually differentiates each of the six identical sums of seven, the numerical sum of seven is obtained by rolling out the color coded first die C with the neutral second die D. When this coding technique is applied, the six identical numerical sums of seven, rolled out with the pair of dice B, will turn up in the following visually differentiated ways: The numerical value, one, represented by a single pip on, for example, the red face of die C, color series E, added to the numerical value, six, represented by six pips on the face of die D, gives a red seven; the numerical value, two, represented by two pips on, for example, the yellow face of die C, in color series F, added to the numerical value, five, represented by five pips on the face of die D, gives a yellow seven; the numerical value, three, represented by three pips on, for example, the green face of die C, in color series G, added to the numerical value, four, represented by four pips on the face of die D, gives a green seven; the numerical value, four, represented by four pips on, for example, the blue face of die C, in color series H, added to the numerical value, three, represented by three pips on the face of die D, gives a blue seven; the numerical value, five, represented by five pips on, for example, the orange face of die C, in color series I, added to the numerical value, two, represented by two pips on the face of die D, gives a orange seven and the numerical value, six, represented by six pips on, for example, the purple face of die C, in color series J, added to the numerical value, one, represented by a single pip on the face of die D, gives a purple seven. Hence, each of the identical six coded numerical sums of seven is rolled out with equal probability of 1 in 36 and is visually differentiated one from the other.

When the color coded first die C, and the neutral second die D are shaken and rolled out over an extended period of time, each of the thirty-six visually differentiated numerical sums A, in the visual grid system, will be obtained from the following series: six red sums E, ranging in value from two through seven; six yellow sums F, ranging in value from three through eight; six green sums G, ranging in value from four through nine; six blue sums H, ranging in value from five through ten; six orange sums I, ranging in value from six through eleven and six purple sums J, raging in value from seven through twelve. Examination of FIG. 1, clearly shows that each of the thirty-six color coded sums in coded series E, F, G, H, I and J is visually different, one from the other and will turn up with equal odds of 1 in 36.

Color may be substituted with a variety of symbols to differentiate each of the six faces on the coded numbered die C. For example, the four symbols used in a standard poker deck, that is, the Diamond, Heart, Club and Spade, to which may be added to five-pointed Star and full Moon, sometimes called figure symbols, would constitute six separate and visually distinguishable symbols that can be imprinted on each of the six numbered faces to produce a coded die. Another example is to use the first six letters of the alphabet as figure symbols for the coded die.

Since approximately 2% of the present U.S. population are color-blind, symbols imprinted on the coded numbered die, would afford everyone with an equal opportunity to play the variety of potential games that can be developed from the instant invention.

Whatever coding technique is adopted for the coded numbered die C, be it colors or any type of figure symbols, the thirty-six possible numerical sums A of two six-sided dice will be visually differentiated when each face on one die is coded and each face on the companion die is not coded.

Color or symbol coding each face on one die and retaining each of the numbered faces on a uncoded, companion neutral die is the only possible way any of the thirty-six numerical sums A of two six-sided numbered dice can be visually differentiated, one from the other. Application of this coding technique to pairs of dice having six or more sides, results in the following visually discernable numerical sums: thirty-six (36), for a pair of six-sided numbered dice and up to nine-hundred (900), for a pair of thirty-sided numbered dice, illustrated in Table 3.

From a practical point of view, it may be desirable to limit the number of colors and/or figure symbols, such that a pair of dice may consist of one six-sided coded die combined with a neutral die having more than six sides or vice versa. For example, if a coded six-sided numbered die is rolled out together with a neutral die having twelve numbered sides, seventy-two (72) combinations of the two unequal sided dice are possible, with each combination rolled having equal odds.

The visual grid system illustrated in FIG. 1 of the instant invention, serves as a model that may be applied to establish the number of identical sums that are contained within group sums with any combination of two multi-sided numbered dice and by the application of coding one die in a dice pair to visually differentiate each identical numbered rolled sum, one from the other.

The instant invention is reduced to practice in part, but is not limited herein to four new game examples that are described in detail. Without the means to visually differentiate the thirty-six possible numerical sums A of the two dice B with the coding technique illustrated in FIG. 1, none of the following games could have been developed.

TABLE 3

| CODED DIE ALL SIDES CODED AND NUMBERED (NO. OF SIDES) | | NEUTRAL DIE ALL SIDES NUMBERED (NO. OF SIDES) | NUMERICAL SUMS OF BOTH DICE WITH NO CODING | NUMERICAL SUMS OF BOTH DICE WITH CODING |
|---|---|---|---|---|
| 6 | × | 6 | 11 | 36 |
| 8 | × | 8 | 15 | 64 |
| 12 | × | 12 | 23 | 144 |
| 30 | × | 30 | 59 | 900 |
| 6 | × | 12 | 17 | 72 |
| | | | Varying Odds of Numerical Sums That Are Observed | Even Odds of Numerical Sums That Are Observed |

Game Example I

CHANCE

No. of Players 2 to 6

Figure 2:
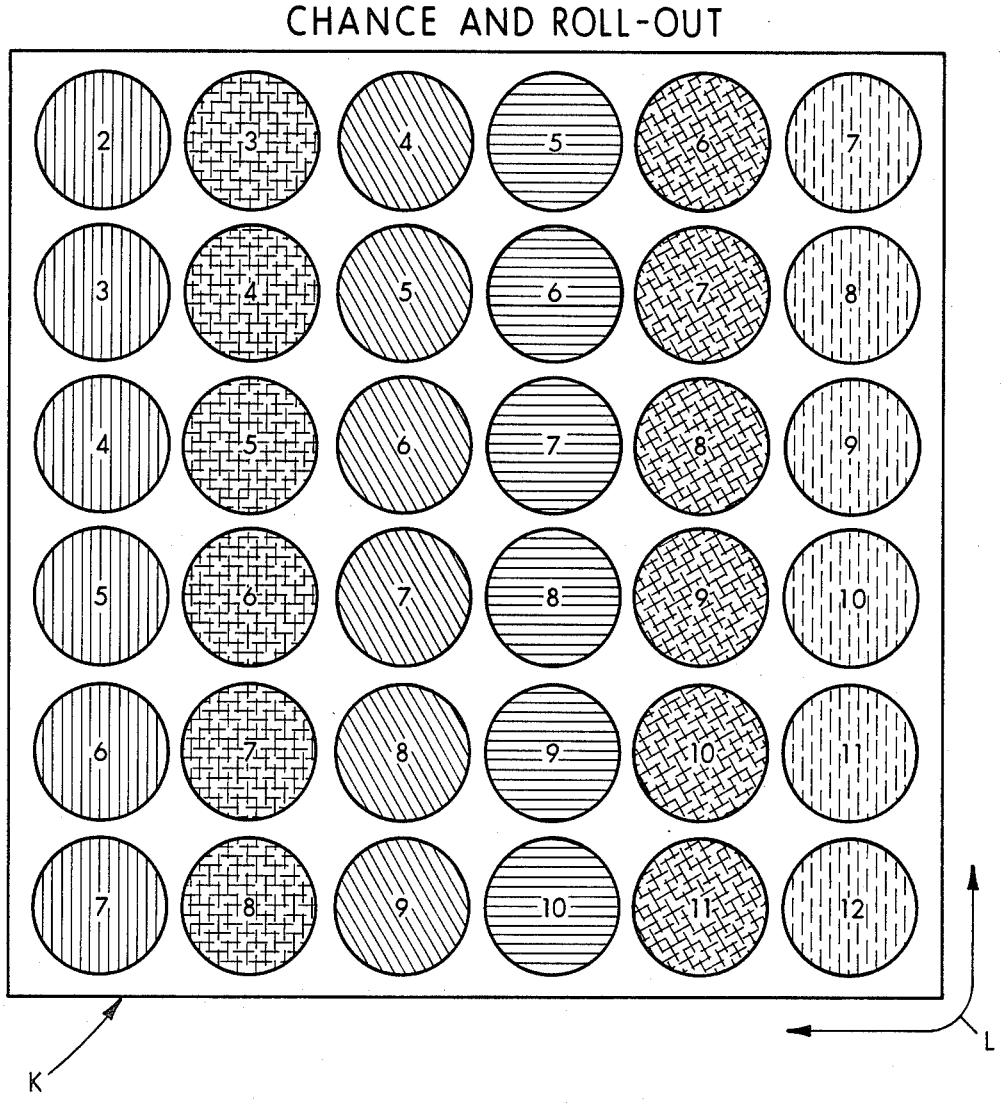
FIG. 2 is a diagrammatic sketch of the game board based on FIG. 1, to play CHANCE and ROLLOUT.

The object of CHANCE is to match one or more selected numbers on the playing board K, illustrated in FIG. 2, with a preselected count of successive rolls of a pair of dice B (FIG. 1).

Prior to commencement of the game, players decide on an equal selection from one to a maximum of six color coded numbers out of the thirty-six L represented on the playing board K, which are identical to the numbers in color coded series E, F, G, H, I and J, illustrated in FIG. 1, of the instant invention. Each player's color coded number selection is then recorded on a scoring pad, which is signed and passed to the player assigned to roll the pair of dice B in the game. After each dice roll, a color coded number L on the playing board K, corresponding to the color coded numerical sum of cast dice B, is covered with a plastic chip. After the dice are roller over a preselected number of times, the game ends, after which each player's numerical selection on the scoring pad is compared to one or more color coded numbers L covered with the plastic chips on the playing board, which is then determines the winner. Depending on the rules adopted prior to the commencement of the game, the winner is determined by the player who has either; (a) the highest numerical score obtained from a composite sum of all matched numbers L or (b) the greatest amount of numbers L matched by rolls of dice B.

Game Example II

ROLL-OUT

No. of Players 2 to 6

The object of ROLL-OUT is to match one or more color coded numbers that appear on cards in a player's hand, with the color coded numbers L that appear on the playing board K, illustrated in FIG. 2. In this game, thirty-six playing cards are used, each of which is imprinted with a number and its corresponding color that appears on the playing board K, for a total of six color-coded cards in six numbered sets. Players may select a dealer or establish one by the highest number rolled with the pair of dice B. The game is played with either one or up to a maximum of six playing cards, depending on the dealer's selection, with card(s) thoroughly shuffled and dealt face down, one at a time to each player, from the dealer's left. Each player takes a turn to roll the dice B. After each dice roll, a color coded number L on the playing board K, corresponding to the color coded numerical sum of the cast dice B, is covered with a plastic chip. If a player holds a card(s) that matches the dice roll, he must lay it out face up. If a player rolls a coded sum L, already covered with a plastic chip, he must pass the dice B to the player on his left. The first player who plays out all of his card(s), wins the game.

Game Example III

STREAK

No. of Players 2 to 14

Figure 3:
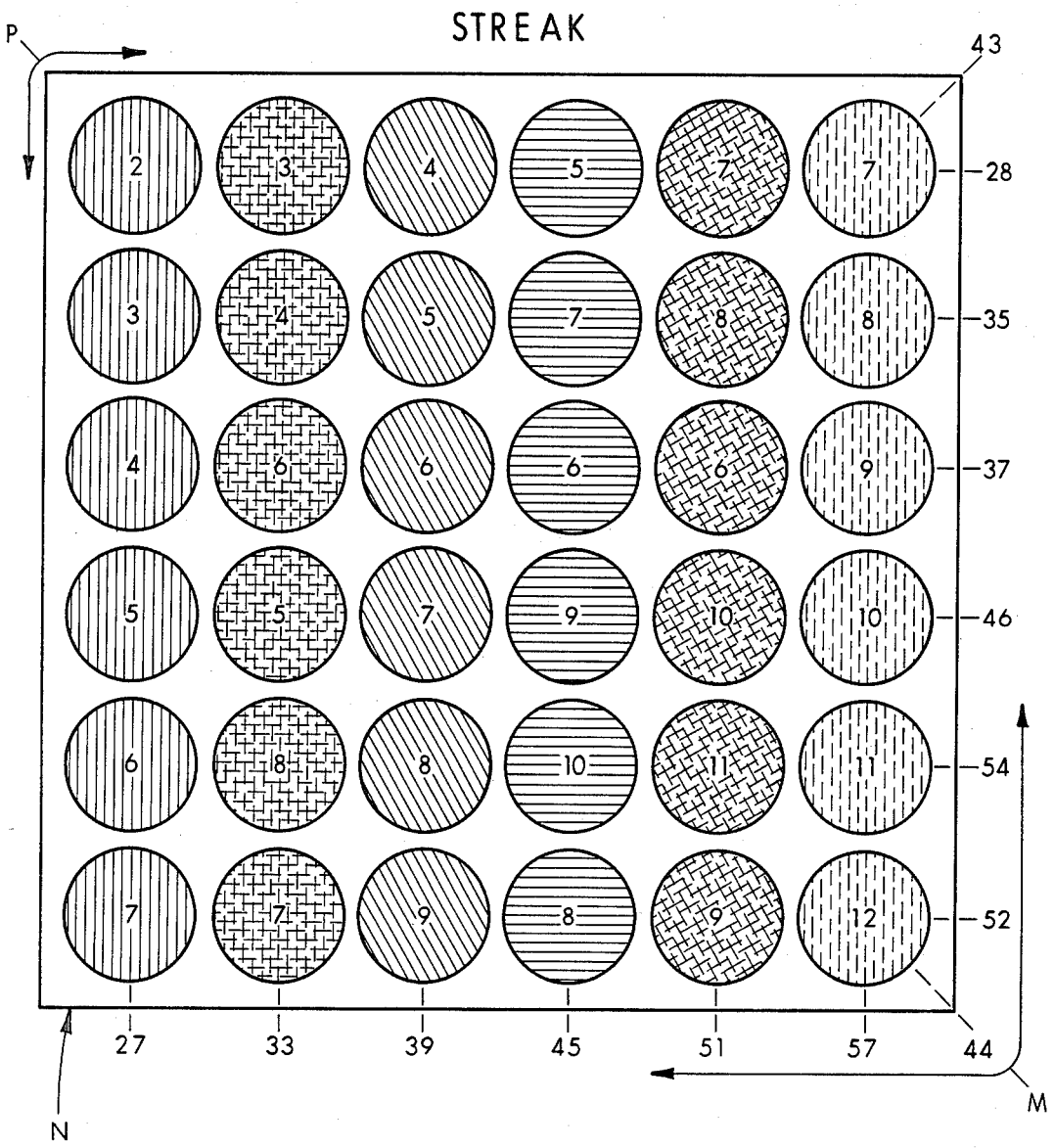
FIG. 3, is a diagramatic sketch of the game board, based on FIG. 1, to play STREAK.

The object of STREAK is to match the number on a single playing card with one of fourteen scores M, each of which is a composite sum of the six color coded numbers that are specifically arranged in each series of six numbers that appear either vertically, horizontally or diagonally on the playing board N, illustrated in FIG. 3. Examination of the playing board N, shows how a series of six color coded numbers, within the thirty-six possible numerical color coded combinations P, produce fourteen possible ways M to score in the game; six vertically, six horizontally and two diagonally. Since the composite numerical sum of any set of six color coded numbers for the fourteen possible ways M to win is different, there are no tie scores to settle in a game of STREAK. In the event, players simultaneously match two series of six numbers in a cross-pattern, the player with the highest numerical composite score M wins.

Each of fourteen cards in a deck is imprinted with one of the fourteen composite scores M that appear on the playing board N. Players must agree on who should deal one card of fourteen in the deck to each player, or establish a dealer by the player who rolls the highest score with the pair of dice B. The dealer thoroughly shuffles the fourteen cards and each player is dealt, one card, face down, from the dealer's left. The player on the dealer's left starts the game sequence by rolling the pair of dice B. When a number turns up with a color that matches one of the color coded numbers on the board N, the player places a plastic chip on that number. If a player rolls a coded sum P, already covered with a plastic chip, he must pass the dice B to the player on his left. The game sequence continues from one player to the next, until one player matches a series of six numbers running either vertically, horizontally, or diagonally on the board N. The player who holds the card with a composite sum of any six color coded numbers that match one of the fourteen composite scores M on the board N, wins the game.

Game Example IV

PENTANGLES

Figure 4:
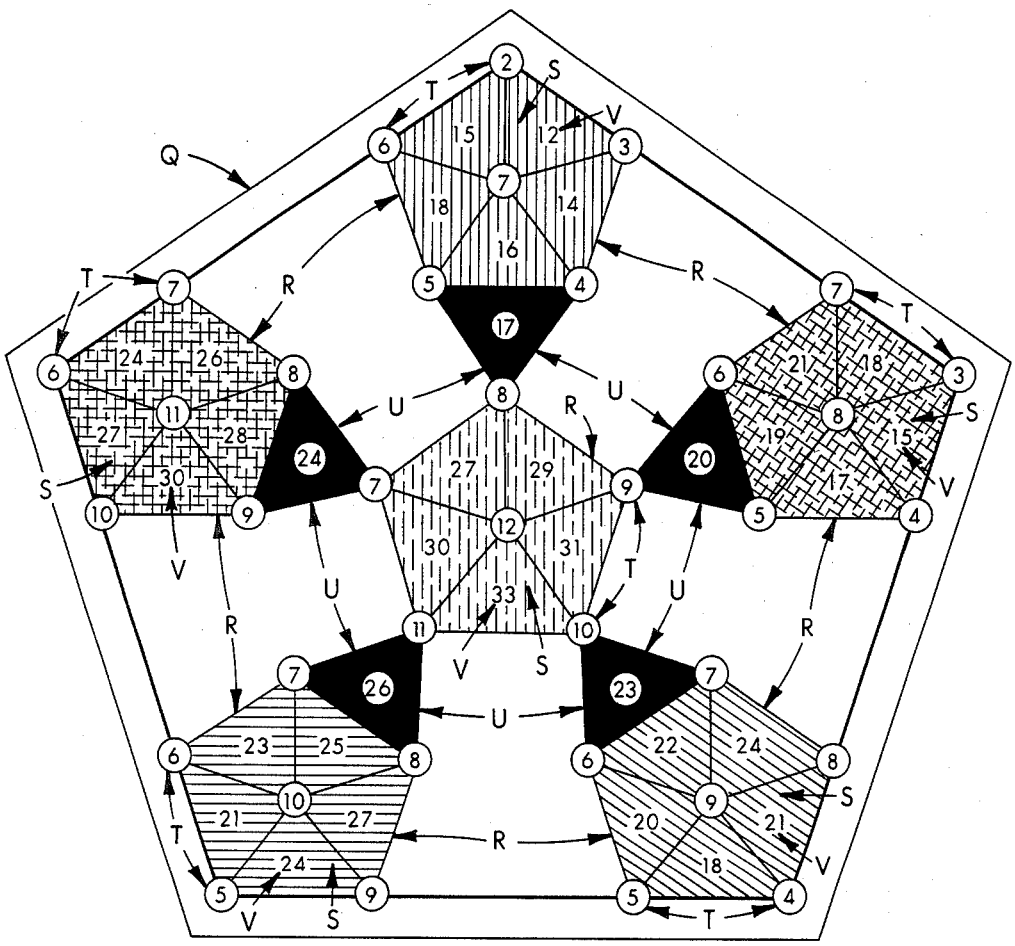
FIG. 4, is a diagrammatic sketch of the game board, based on FIG. 1, to play PENTANGLES.

The PENTANGLES playing board Q, illustrated in FIG. 4, consists of six interconnected color coded pentagons R, arranged in a unique geometrical pattern that results in one large pentagon shaped playing board Q. Each of the six pentagons R, is subdivided into five triangular sections S. The six circled numbers T that make up each pentagon R, match the six numbers within each color coded series E, F, G, H, I and J as illustrated in FIG. 1, of the instant invention. Each of the six pentagons R, matches a color that appears on each of the six faces on the color coded die C. Since there are six circled numbers T within each pentagon R, all six interconnected pentagons R, project all thirty-six possible combinations of numbers A that can be rolled and visually differentiated with the pair of dice B.

All thirty colored triangles S, including the five interconnecting, for example, black ones U, contain a two digit number V located in the center of each triangle S and U. The two digit number V, within each triangle S and U is the numerical sum of any three circled numbers T, that complete triangles S and U. Since all two digit numerical sums V within each color coded and black triangles S and U are different, no tie scores are possible in any kind of PENTANGLES game.

(a) DICE PLAYING VERSION

No. of Players 2 to 8

The object of the dice version of PENTANGLES is to match any set of three circled numbers T that completes any one of the thirty-five triangles S and U that appear on the playing board Q, with successive rolls of the dice B.

Each player rolls the pair of dice B once. The player who rolls the highest number starts the game.

After each player rolls the dice once, a plastic chip is placed over the circled number T on the color matched pentagon R. When a player rolls the dice and a number turns up that has already been covered with a plastic chip, he must pass the dice to the next player to his left. The first player who covers the last of three circled numbers T that completes a triangle S and U, wins the game. In the event two adjacent triangles are completed at the same time, the player having the highest two digit score V wins. Since all combinations of adjacent triangles have different two digit numerical values, there is no possibility of a tie score.

(b) CARD PLAYING VERSION

No. of Players 2 to 8

The object of the card version of PENTANGLES is to match any set of three circled numbers T that complete a triangle S and U on the playing board Q with a playing card having a two digit numerical sum of V of three circled numbers T.

In this game version, thirty-five playing cards are used, each of which is imprinted with one of the two-digit numbers V represented from within each of the thirty-five triangles S and U that appear on the playing board Q.

The first player who rolls the highest number with the pair of dice B, thoroughly shuffles the thirty-five playing cards, and then deals one, two or three cards (dealer's choice), to each player, one at a time, face down, from the dealer's left.

The player to the dealer's left starts the game by rolling the dice B once. As the game progresses from one player to the next, plastic chips are placed on the matching circled board numbers T. When a player rolls the dice and a number T turns up that has already been covered with a plastic chip, he must pass the dice to the next player to his left. When three plastic chips complete a triangle S and U, players then check to see if their two digit numbered sum on any of their cards, matches the two digit numbered sum V within any of the triangles S and U on the playing board Q. The first player who plays out all of his cards, wins the game. Since all combinations of adjacent triangles have different two digit numerical values, there is no possiblity of a tie score.

Both the DICE (a) and the CARD (b) game versions can be played in series. Players agree on a target score, of for example 1000 points. The first player to reach the target score over several games, wins the series. Scores at the end of each game in a series, are recorded on a scoring pad. Game versions (a) and (b) played in series, provide a few hours of family entertainment.

(c) PENTAGON

No. of Players 2 to 6

The object of PENTAGON is to match and cover the five outer circled numbers T that make up any one of the six color coded pentagons R within the playing board Q, by successive rolls of the dice B.

A dealer is selected by the highest number rolled with the pair of dice B.

Six color coded pentagon shaped playing cards, each of which matches one of the six color coded pentagons R that appear on the playing board Q, are shuffled and one card is dealt, either face up or down (dealer's choice) to each player from the dealer's left.

The player to the dealer's left starts the game by rolling the dice B once. Each player in turn, rolls the dice once. When a player rolls a color coded number T, already covered with a plastic chip, he must pass the dice to the player on his left. The first player who covers the last five circled numbers T that completes a pentagon R matching the color of his pentagon shaped playing card wins.

The diagrammatic sketches of the playing boards used in Game Examples I through IV, as illustrated in FIGS. 2, 3, and 4, in combination with dice B, can easily be adapted for use in any type of electronically automated system that may incorporate either video or computer components.

While the invention has been described with specific embodiments thereof, it will be understood that it is capable of further modification and variation as apparent to those skilled in the art of coding dice.

I claim:

1. A pair of multi-sided dice, comprising one neutral die having thereon a plurality of flat faces of equal area, all of said faces provided with the same background indicia, each face additionally carrying means representing a numeral, said represented numerals being different, said represented numerals further being consecutive in ascending order, commencing with the represented numeral one; and one coded die having thereon the same number of flat faces as said neutral die, each face of said coded die carrying means representing a different numeral, the numerals represented on said coded die faces being the same, as those on said neutral die faces, and each face on said coded die carrying additional indicia, different from that on each other face and different from said background indicia on said neutral die; whereby the result of a throw of the pair of dice can be read by a combination of said additional indicia on the upper face of said coded die and the sum of the represented numerals appearing on the upper face of each die.

2. The pair of multi-sided dice described in claim 1, combined with a game board, upon which each visually differentiated numerical sum rolled out by the dice pair is displayed, thus constituting an apparatus, whereby a variety of different games can be played.

* * * * *